US010221558B1

(12) United States Patent
Silva et al.

(10) Patent No.: US 10,221,558 B1
(45) Date of Patent: Mar. 5, 2019

(54) FOUNDATION CONNECTION DEVICE FOR USE DURING CONSTRUCTION OF CONCRETE WALL PANELS

(71) Applicants: Elena Silva, Tampa, FL (US); Manuel R. Linares, IV, Tampa, FL (US)

(72) Inventors: Elena Silva, Tampa, FL (US); Manuel R. Linares, IV, Tampa, FL (US)

( * ) Notice: Subject to any disclaimer, the term of this patent is extended or adjusted under 35 U.S.C. 154(b) by 0 days.

(21) Appl. No.: 15/875,515

(22) Filed: Jan. 19, 2018

Related U.S. Application Data

(60) Provisional application No. 62/451,873, filed on Jan. 30, 2017.

(51) Int. Cl.
*E04B 1/41* (2006.01)
*E04B 1/04* (2006.01)

(52) U.S. Cl.
CPC ..... *E04B 1/4114* (2013.01); *E04B 1/043* (2013.01); *E04B 2103/02* (2013.01)

(58) Field of Classification Search
CPC ..... E04B 1/4114; E04B 1/043; E04B 2103/02
See application file for complete search history.

(56) References Cited

U.S. PATENT DOCUMENTS 919,771 A * 4/1909 Roberts ..... E04H 12/08 52/152
2,137,767 A * 11/1938 Betcone ..... E04B 2/58 52/274
3,049,201 A * 8/1962 Hannoosh ..... E04B 1/3211 403/172
3,621,626 A * 11/1971 Tylius ..... E04B 1/043 403/363
5,317,850 A * 6/1994 Colonias ..... E04B 1/0007 52/293.3
5,609,005 A * 3/1997 Schierloh ..... E04B 1/355 249/83
7,509,777 B2 3/2009 Nakaki et al.
7,743,580 B2 * 6/2010 DeLoach, Sr. ..... E04B 1/41 52/659
8,011,144 B2 * 9/2011 Compton ..... E02D 27/02 249/2
D672,221 S 12/2012 Tincher
8,448,397 B2 * 5/2013 Tincher ..... E04B 1/4114 249/83
2011/0146181 A1 6/2011 Traulsen et al.
2011/0239581 A1 * 10/2011 Linares, III ..... E04B 1/043 52/699
2018/0258632 A1 * 9/2018 Francies, III ..... E04B 1/4114

FOREIGN PATENT DOCUMENTS

DE 10234808 A1 * 2/2004 ..... E04B 1/043
WO WO-2015054735 A1 * 4/2015 ..... E04B 1/04

* cited by examiner

*Primary Examiner* — Jeanette E Chapman
(74) *Attorney, Agent, or Firm* — Thomas Frost

(57) ABSTRACT

The present invention relates to a foundation connection device to assist in the construction and mounting of tilt-up and precast concrete wall panels used to form walls of a building. The device comprises a base plate with an upwardly angled post with a cavity defined therethrough formed on an upper surface of the plate. At a first end of the post an opening is defined through the plate, and at a second end of the post a flange with a passage is formed. An anchor rod extends upwardly from the post. The device is secured to a concrete foundation by inserting a square rod through the post into a pre-drilled hole in the foundation.

1 Claim, 3 Drawing Sheets

FOUNDATION CONNECTION DEVICE FOR USE DURING CONSTRUCTION OF CONCRETE WALL PANELS

FIELD OF THE INVENTION

The present invention relates to a foundation connection device to assist in the construction and mounting of tilt-up and precast concrete wall panels used to form walls of a building.

BACKGROUND OF THE INVENTION

Tilt-up and precast concrete wall panels are used to construct typically commercial buildings, such as warehouses and factories. Such construction entails building a rectangular concrete form, from on site in the case of tile up and off site in the case of precast, mounting steel reinforcing rebar or other reinforcement in the form, filling the form with concrete, and after the concrete cures, lifting the resulting concrete panel into place creating a wall section. Numerous wall sections generally are fabricated and attached together to frame members of the building to construct complete walls. Utility conduits may be embedded within the wall sections as needed to provide electricity and plumbing.

In traditional concrete wall panel construction, the forms into which the concrete is poured are usually fabricated from wood or metal at a worksite, and are on the ground adjacent to the location where the wall is formed. A high level of skill is required to assure the panels are all the correct size and configuration.

Certain problems currently exist that are addressed by the present invention. One problem is the lateral forces present with tilt-up concrete wall panels (such as those produced by a hurricane or an earthquake). Another problem is the need to resist tension forces created from shear forces from the roof diaphragm that cause the panel to overturn. While it is known to attach base plates to the wall panels and to embed prelocated vertical anchor bolts within the foundation receiving the base plates, there is a problem in obtaining precision location of the base plate on the wall panels and corresponding precision location of the bolts within the foundation so that the wall panels are precisely positioned and aligned after the wall panels are erected.

SUMMARY OF THE INVENTION

The general purpose of the present invention, which will be described subsequently in greater detail, is to provide a new and improved foundation connection device.

The current invention comprises an anchoring device which is embedded in the concrete wall panels, under 7" in thickness, during construction and remains in the panel to assist in securing the wall panel to the concrete foundation. A plug or the like is positioned at the distal end of the embedded anchoring device for removal. The plug is removed after the mounting of the panel. Drilling is required into the foundation to create a continuous void through the tilt-up panel and into the foundation. A connecting rod is inserted to connect the tilt-up panel to the concrete foundation, and grout or epoxy is used to fill in the void and finish the connection. This system satisfies foundation connection requirements that may be required by local building construction codes.

The invention allows for no field welding, no threaded bolts or expansion anchors, and eliminates the use of embedment plates that can be mis-located.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
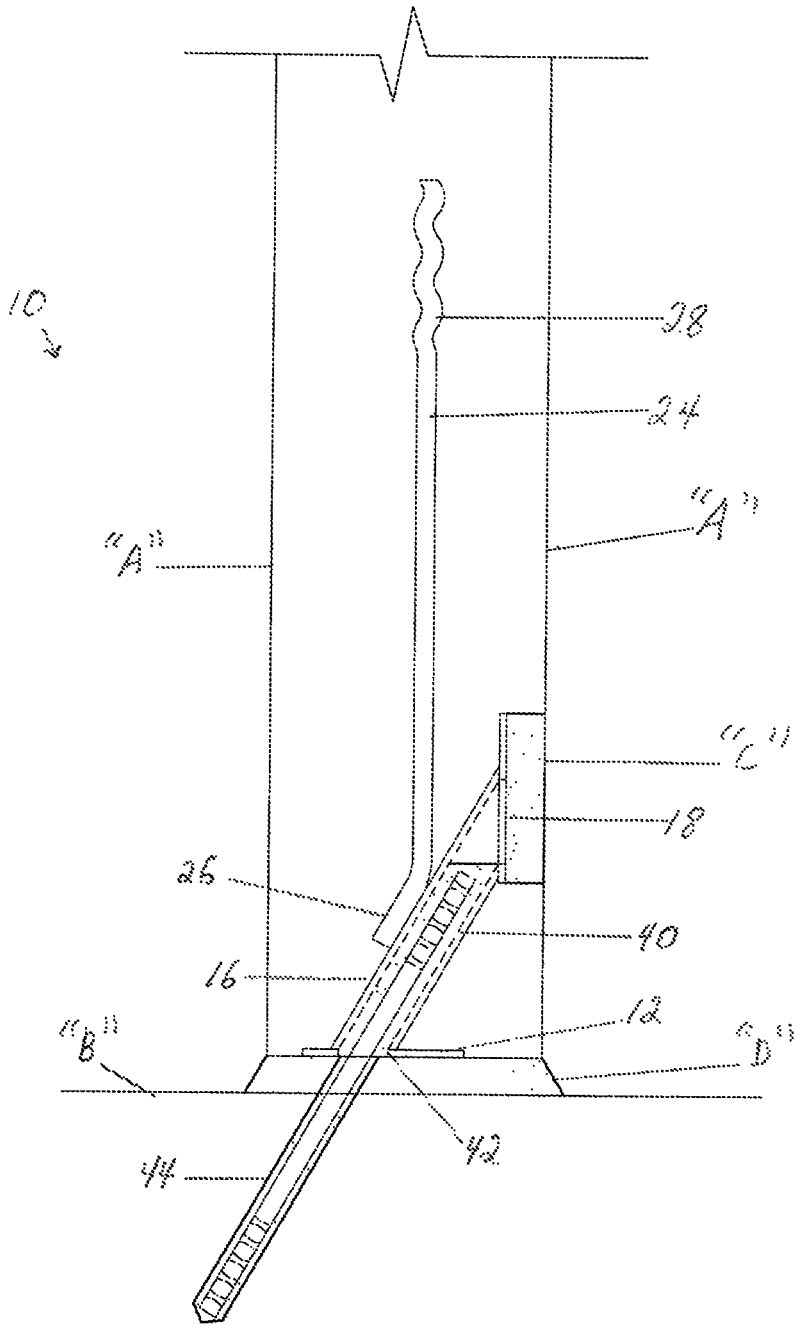
FIG. 1 is a cross-sectional side elevational view of an embodiment of the present invention in use.
Figure 2:
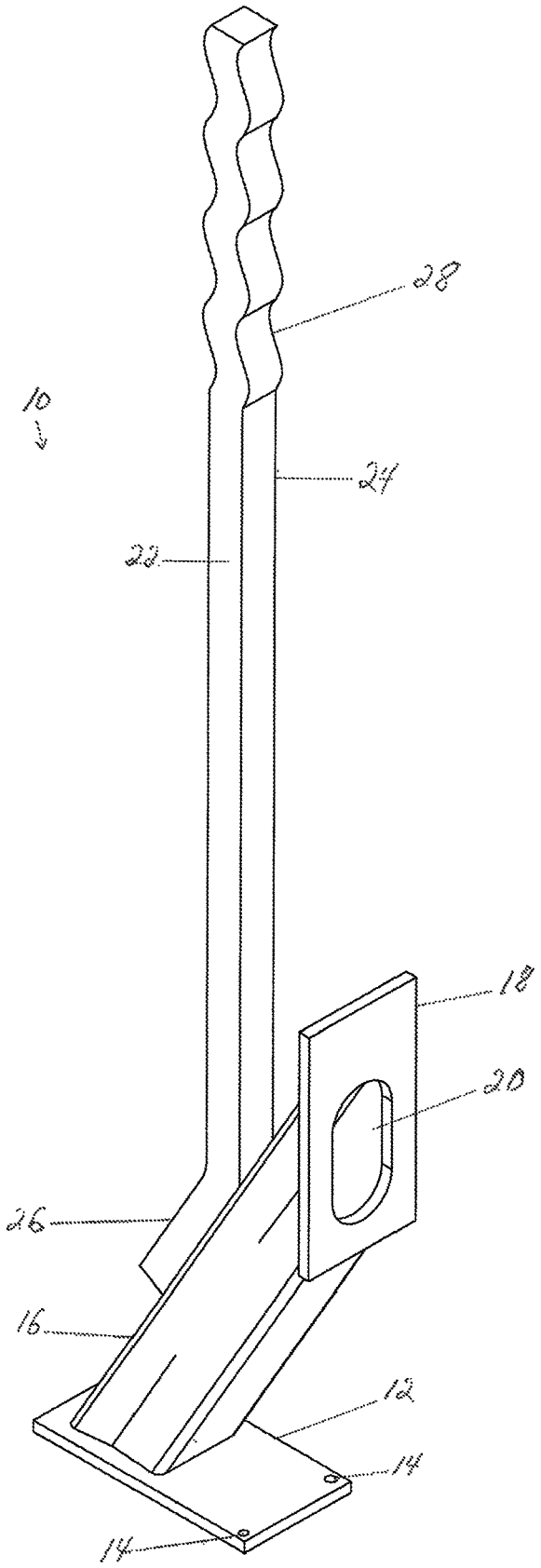
FIG. 2 is a frontal perspective view of an embodiment of the present invention with the plug removed from the opening.
Figure 3:
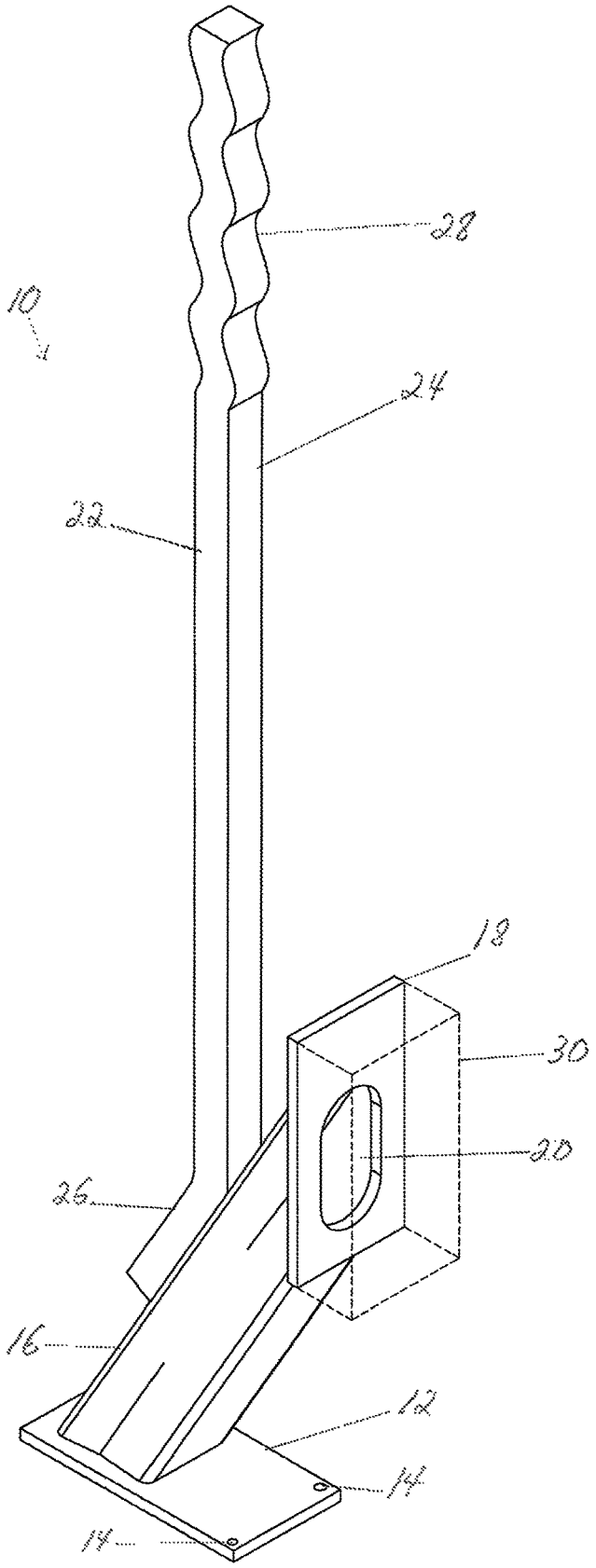
FIG. 3 is a frontal perspective view of an embodiment of the present invention.

Referring generally to the FIGS. 1-3, an embodiment 10 of the present invention is illustrated. A foundation connection device 10 has a generally rectangular substantially flat base plate 12 having an upper surface and a lower surface, with a pair of apertures 14 formed through the base plate 12 at opposed corners. On the upper surface of the base plate 12, a tubular post 16 is integrally formed. An inner surface of the post 16 defines a cavity 40 therethrough. A first end of the post 16 defines an opening 42 through the base plate 12. The post 16 angles upwardly at approximately 45 degrees. At the second end of the post 16 a rectangular flange 18 with a passage 20 defined therethrough is formed.

An anchor rod 22 having an upper section 24 having a first end and a second and a lower section 26 with first and second ends, with the lower section 26 aligned perpendicular to the outer surface of the post 16, is attached to the post 16. The upper section 24 is angled upwardly from the lower section 26, and has a sinuously shaped portion 28 at its second end.

A detachable plug 30 is secured to the flange 18 over the passage 20, and adapted to extend substantially flush with a side surface of the wall panel during construction. The plug 30 is preferably formed of Styrofoam material, although the composition of the plug is not limited to any composition. The plug 30 inhibits material from entering the second end of the post 16 during the construction of the wall panels.

The final location of the device 10 embedded in concrete wall panels "A" is illustrated in FIG. 3. Initially, the device 10 is securely mounted perpendicular to the wooden formwork by nails positioned through the apertures 14 of the base plate 12. The flange 18 is aligned parallel to the concrete wall panels. The standard procedures of the construction of the wall panels are followed and the panels are erected as normally performed. Panel bearing grout "D" is applied. The plug 30 is removed on the face of the concrete wall panel. Using the cavity 40 of the post 16 as a guide, a 1" diameter hole at least 7" deep is drilled into the concrete foundation "B." Along with certain grouting procedures, including pouring fluid non-shrink grout into the cavity 40 of the post 16, a ⅝" ductile square rod 44, having a sinuously shaped portion at both ends, and adapted to extend through the cavity 40 and the passage 20, is inserted through the post 16 and the base plate 12 to secure to an inclined hole formed in the concrete foundation. Additional grouting is added to fill the length of the cavity 40 to the top of the post 16. Patching grouting "C" is added to fill the passage 20 left by the plug 30 being removed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

We claim:

1. A foundation connection device for securing a vertical concrete wall panel to a supporting concrete foundation, comprising in combination:

a flat rectangular base plate having an upper surface and a lower surface, and having a pair of apertures formed through the base plate at opposed corners;

a tubular post having a first end and a second end with a cavity defined along an inner surface of the post, whereby the post is integrally formed on the upper surface of the base plate depending upwardly, and further having a rectangular flange with a passage defined therethrough formed on the second end of the post and having an opening through the base plate defined at the first end of the post;

an anchor rod having an upper section having a first end and a second end, a lower section having a first end and a second end, with the lower section mounted and aligned perpendicular to the outer surface of the post, and whereby the upper section is angled upwardly from the lower end at the first end of the upper section; and a detachable plug secured to the flange of the post.

* * * * *